US006224563B1

(12) United States Patent
Nonoue et al.

(10) Patent No.: US 6,224,563 B1
(45) **Date of Patent: *May 1, 2001**

(54) BACKREST WITH FINGERS PROVIDING KNEADING MASSAGE

(75) Inventors: Torahiko Nonoue, Kakogawa; Yoshiya Furuie, Himeji; Takahiro Yuchi, Kanzaki-gun; Takeya Matsushita; Yasuhiro Jikiba, both of Kasai, all of (JP)

(73) Assignee: Sanyo Electric Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/938,317

(22) Filed: Sep. 26, 1997

(30) Foreign Application Priority Data

Sep. 30, 1996 (JP) ..... 8-258210
Sep. 30, 1996 (JP) ..... 8-258258

(51) Int. Cl.[7] ..... A61H 15/00

(52) U.S. Cl. ..... 601/99; 601/100; 601/101; 601/103; 601/111; 601/116

(58) Field of Search ..... 601/63, 90–95, 601/98–103, 115, 116, 111

(56) References Cited

U.S. PATENT DOCUMENTS 4,422,448 * 12/1983 Sugai et al. ..... 128/44
4,718,408 1/1988 Barreiro .
4,875,470 * 10/1989 Contone ..... 128/57
5,233,973 8/1993 Gill et al. .
5,352,186 * 10/1994 Yamasaki et al. ..... 601/99
5,460,598 10/1995 Yamasaki et al. ..... 601/99

FOREIGN PATENT DOCUMENTS 2 143 438 2/1985 (GB) .

* cited by examiner

*Primary Examiner*—Danton D. DeMille
(74) *Attorney, Agent, or Firm*—Armstrong, Westerman, Hattori, McLeland & Naughton, LLP

(57) ABSTRACT

A massage machine is provided which is adapted for effective massage by initiating a pair of therapeutic fingers into a lateral movement toward or away from each other approximately simultaneously with the start of an upward or downward movement of the fingers. The massage machine comprises the therapeutic fingers arranged on the backrest of a chair, bed or the like for supporting the back of the person to be massaged, lift means for moving the therapeutic fingers upward and downward longitudinally of the backrest, means for laterally moving the therapeutic fingers toward and away from each other, and control means for initiating the therapeutic fingers into a movement toward or away from each other by the laterally moving means approximately simultaneously with the start of an upward movement of the fingers by the lift means and for initiating the fingers into a movement toward or away from each other by the laterally moving means approximately simultaneously with the start of a downward movement of the fingers by the lift means.

6 Claims, 15 Drawing Sheets

BACKREST WITH FINGERS PROVIDING KNEADING MASSAGE

FIELD OF THE INVENTION

The present invention relates to the operation of therapeutic fingers of a massage machine, and more particularly to a massage machine for producing improved massage effects.

BACKGROUND OF THE INVENTION

Massage machines of the chair type or bed type are already known for massaging the shoulders, waist or other affected part of the person to be massaged. Such machines have a backrest for supporting the back of the person leading thereon, and a pair of therapeutic fingers positioned on the backrest inwardly thereof. The therapeutic fingers are moved toward and away from each other laterally by driving a motor to treat the affected part by "nipping-kneading massage", or moved up and down longitudinally of the backrest by another motor to treat the person from the scruff of the neck toward the waist by "rolling massage".

To give an enhanced massage effect, Japanese pre-examination publication SHO 62-253060 discloses a similar device wherein a motor for reciprocatingly moving the therapeutic fingers is so controlled by a timer that the direction and speed of rotation of the motor are changed every time the timer produces a time-up output to alter the operating speed of the fingers. With this device, the therapeutic fingers move inwardly and outwardly of the backrest in a circular motion to apply a finger pressure, and a unit carrying the fingers and the motor is movable upward and downward along the backrest of the chair by a lift motor.

With the massage machine described, the speed of rotation of the motor for driving the therapeutic fingers is determined by the timer regardless of the direction of movement of the fingers, with the result that the kneading direction of the fingers is not always in conformity with the speed of movement of the fingers to entail variations in the intensity of therapy given by the fingers. Thus, it is difficult to perform effective massage with distinct movements.

An object of the present invention is to provide a massage machine comprising therapeutic fingers which are initiated into movement toward and away from each other approximately simultaneously with the start of up-and-down movement of the fingers so as to perform effective massage with distinct movements.

SUMMARY OF THE INVENTION

The present invention provides a massage machine comprising a pair of therapeutic fingers arranged on the backrest of a chair, bed or the like for supporting the back of the person to be treated (hereinafter referred to as the "user", lift means for moving the therapeutic fingers upward and downward longitudinally of the backrest, and means for laterally moving the therapeutic fingers toward and away from each other, the massage machine being characterized in that the therapeutic fingers are initiated into an upward or downward movement by the lift means approximately simultaneously with the start of a movement of the therapeutic fingers toward or away from each other by the laterally moving means.

The therapeutic fingers are movable upward or downward approximately simultaneously with the movement thereof toward or away from each other to perform effective massage by distinct movements.

For example, the massage machine has control means for causing the laterally moving means to start to move the therapeutic fingers, as spaced apart by the largest distance, toward each other or to start to move the fingers, as spaced apart by the smallest distance, away from each other approximately simultaneously with the start of a downward movement of the therapeutic fingers by the lift means, and causing the laterally moving means to move the therapeutic fingers away from or toward each other at least once while the fingers are being moved further downward after completion of the first movement of the fingers toward or away from each other, and for causing the laterally moving means to start to move the therapeutic fingers, as spaced apart by the largest distance, toward each other or to start to move the fingers, as spaced apart by the smallest distance, away from each other approximately simultaneously with the start of an upward movement of the therapeutic fingers by the lift means, and causing the laterally moving means to move the therapeutic fingers away from or toward each other at least once while the fingers are being moved further upward after completion of the first movement of the fingers toward or away from each other.

The machine can be provided with control means for interrupting the upward or downward movement of the therapeutic fingers by the lift means after the completion of each movement of the fingers toward and/or away from each other by the laterally moving means, subsequently causing the therapeutic fingers as held out of the upward or downward movement to be moved away and/or toward each other at least once, and causing the lift means to resume the upward or downward movement of the therapeutic fingers approximately simultaneously with the start of movement of the fingers toward or away from each other by the laterally moving means after the completion of the subsequent movement of the fingers.

In addition to the massage given to the user by the movement of the therapeutic fingers toward and away from each other, the upward and downward movement of the fingers which is started approximately simultaneously with this movement massages the affected part, and these effects synergestically provide excellent massage.

An upward kneading operation and downward kneading operation can be performed to produce distinct massage effects by starting the approaching-departing movement and initiating the upward-downward movement approximately at the same time. Unless these movements are started approximately simultaneously, it is likely that the therapeutic fingers will descend during the upward movement or ascend during the downward movement in the course of the approaching-departing movement to give incomplete massage of diminished effect.

By causing the therapeutic fingers to move upward and downward over the part of the scruff of the neck through the waist while allowing the fingers to move toward and away from each other, uniform rolling massage can be given to a wide region instead of local massage.

When the fingers as held out of upward or downward movement are moved toward and away from each other after the fingers have been moved toward and away from each other completely, followed by resumption of the upward or downward movement, massage can be given in a wide variety of modes to the satisfaction of the user.

Figure 7A:
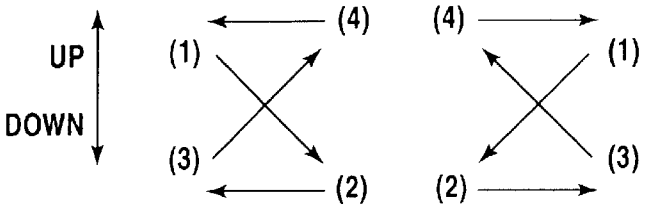
Figure 7B:
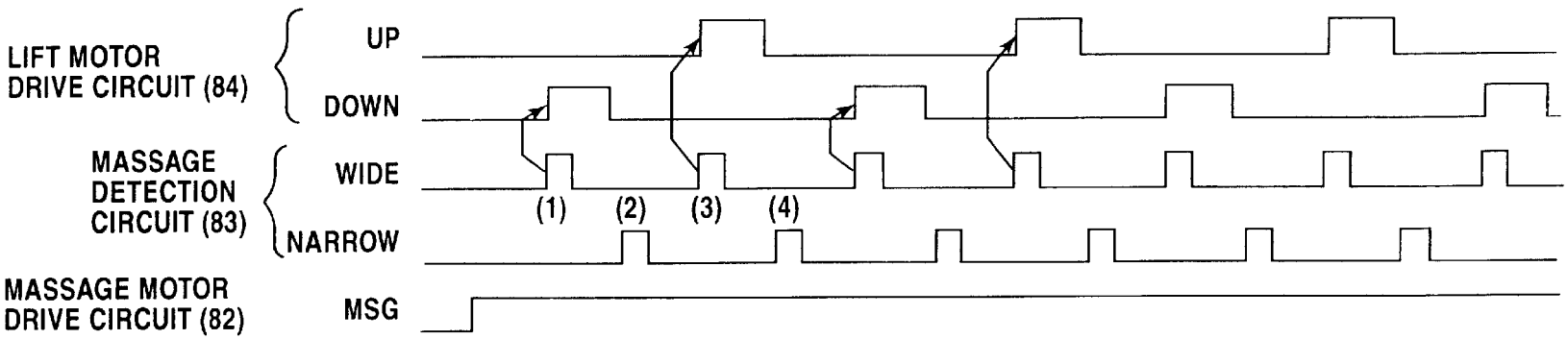
Figure 8:
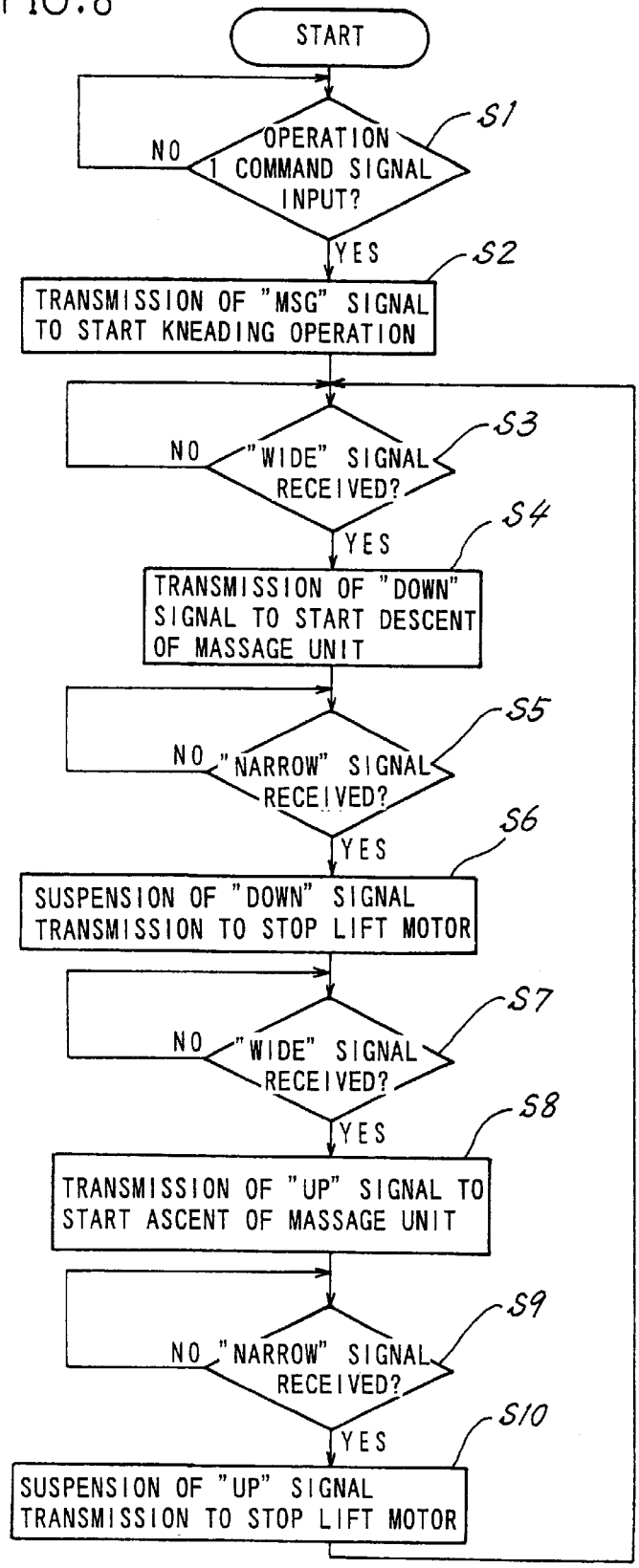
Figure 9A:
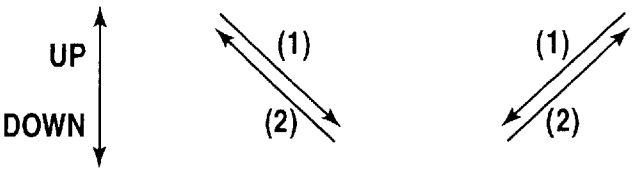
Figure 9B:
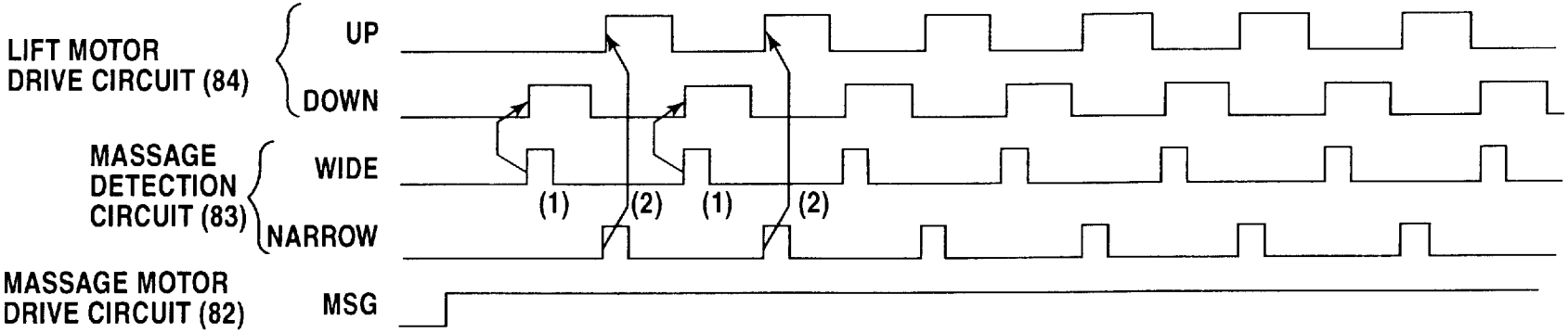
Figure 10A:
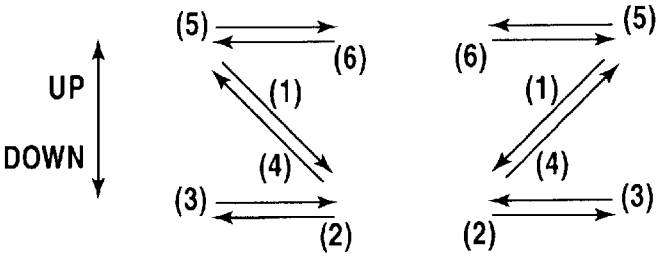
Figure 10B:
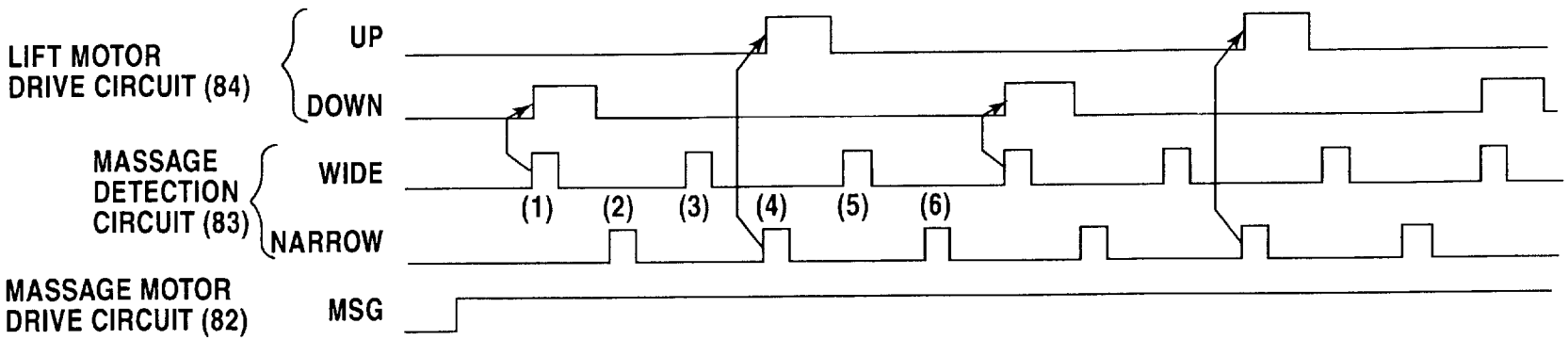
Figure 11:
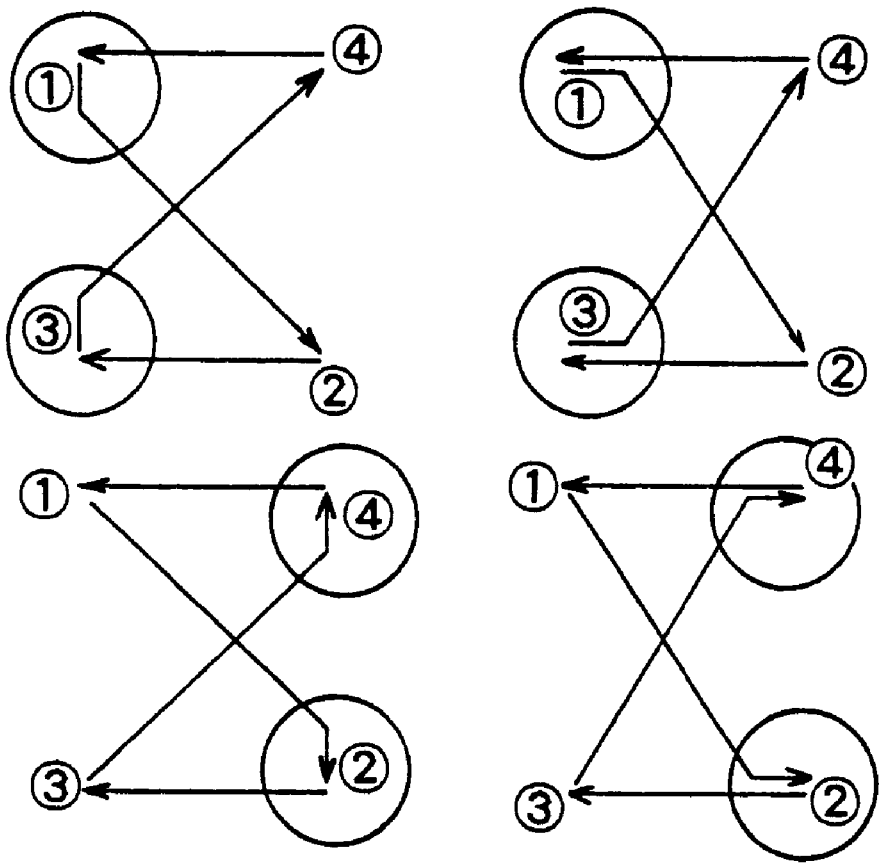
Figure 12A:
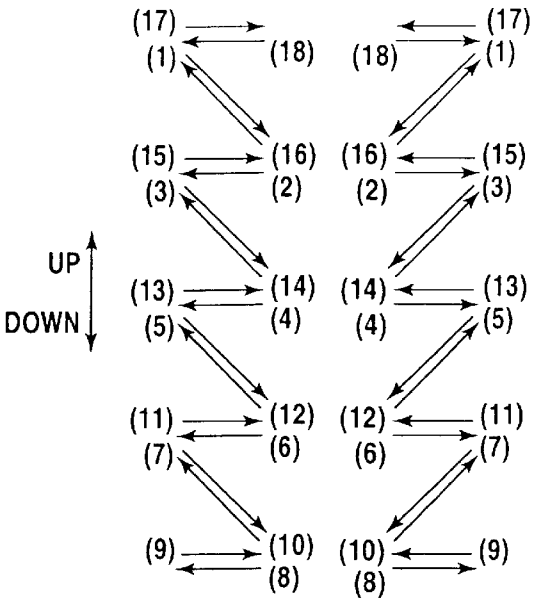
Figure 12B:
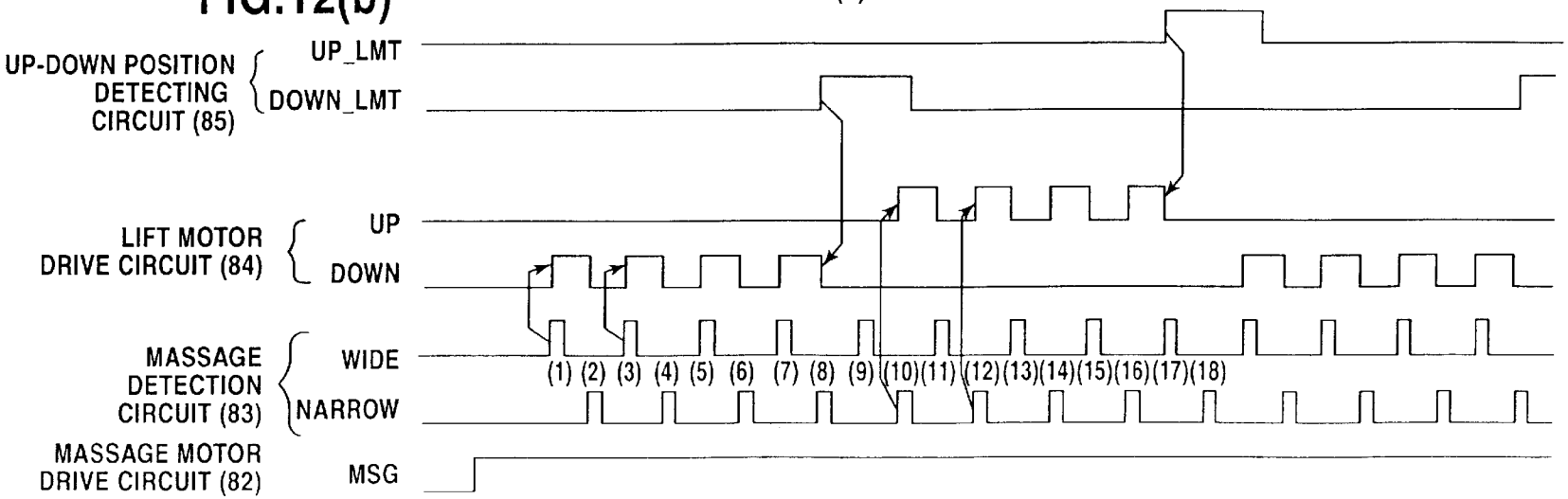
Figure 13:
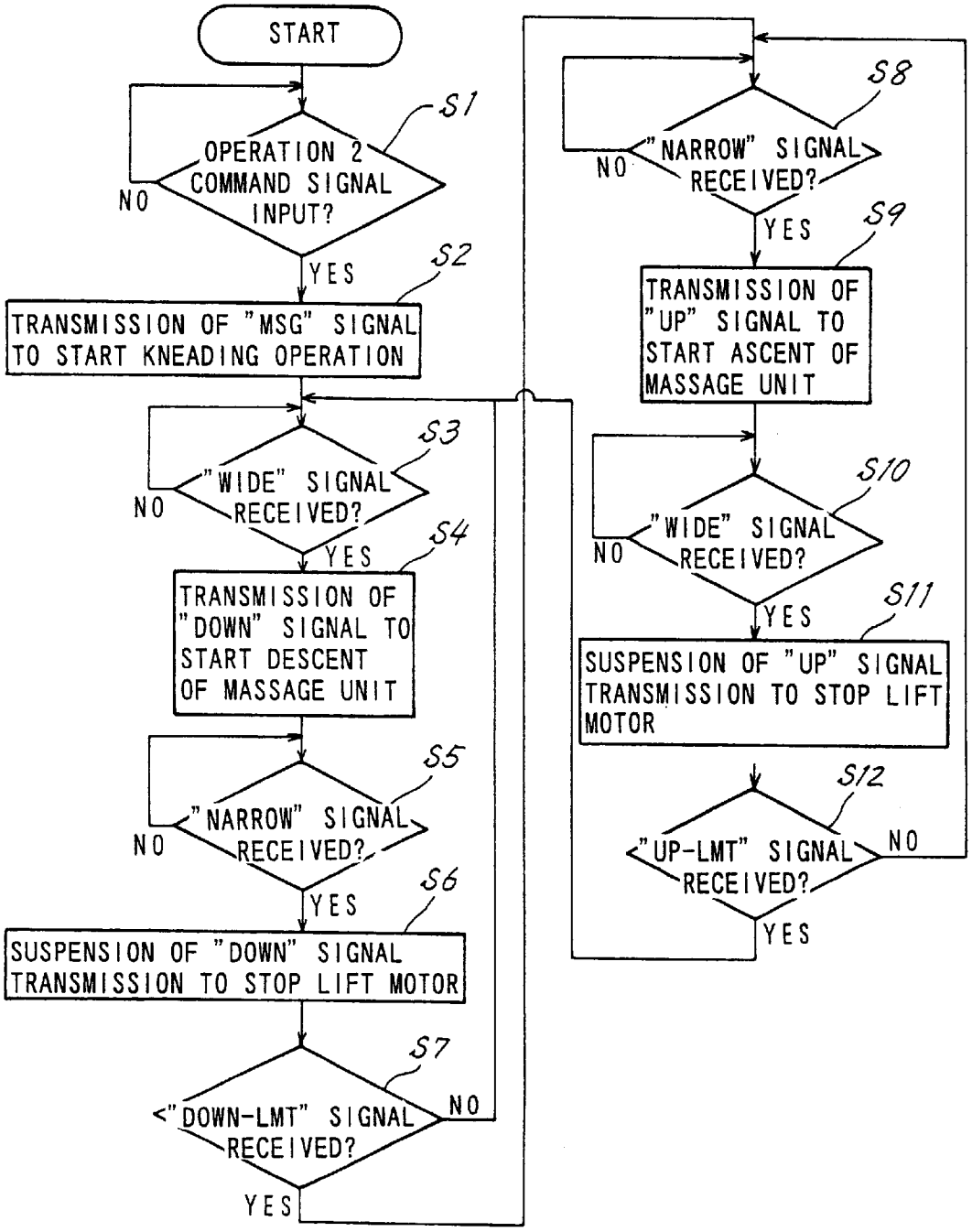
Figure 14A:
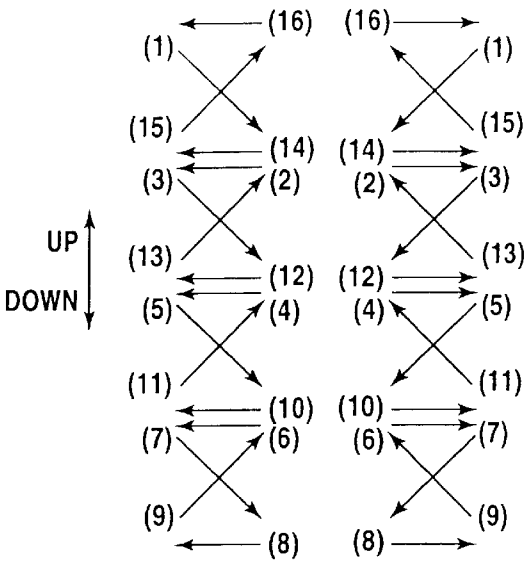
Figure 14B:
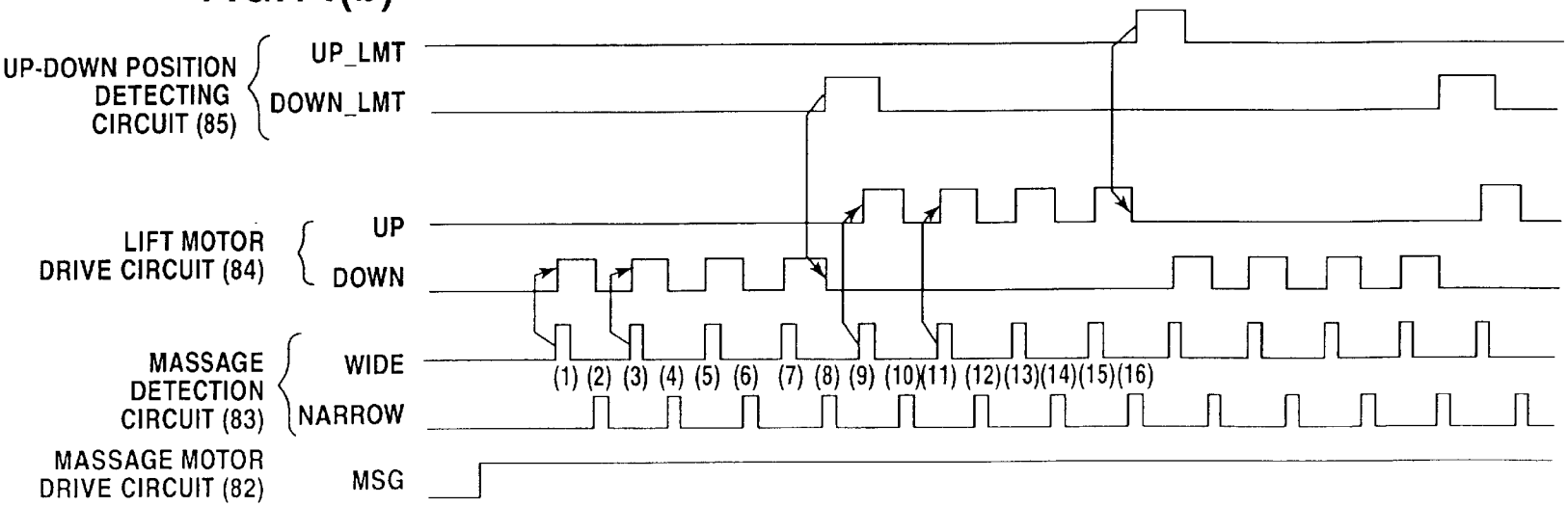
Figure 15A:
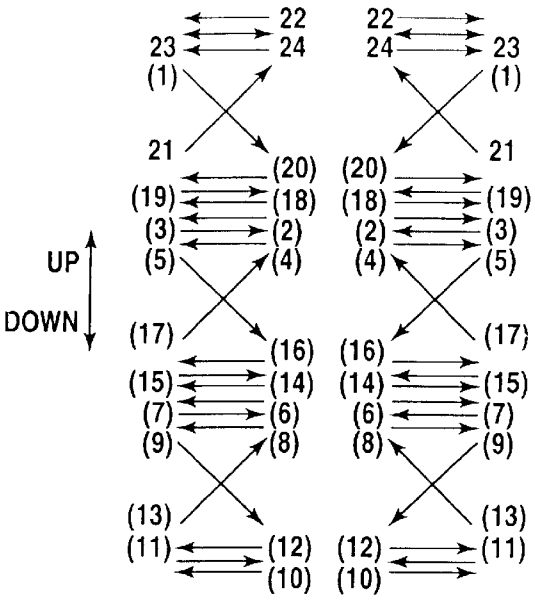
Figure 15B:
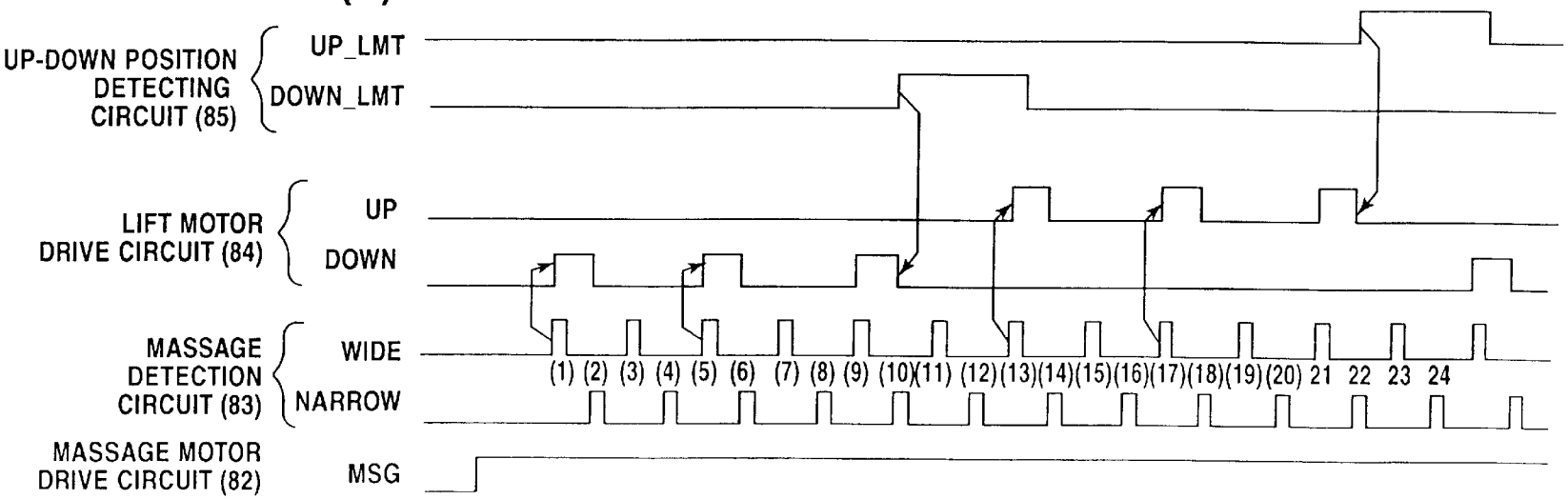
Figure 16A:
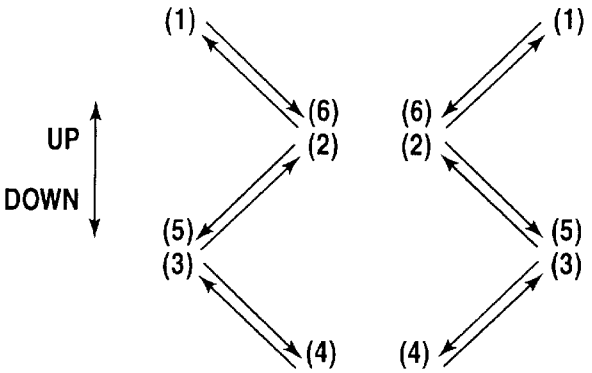
Figure 16B:
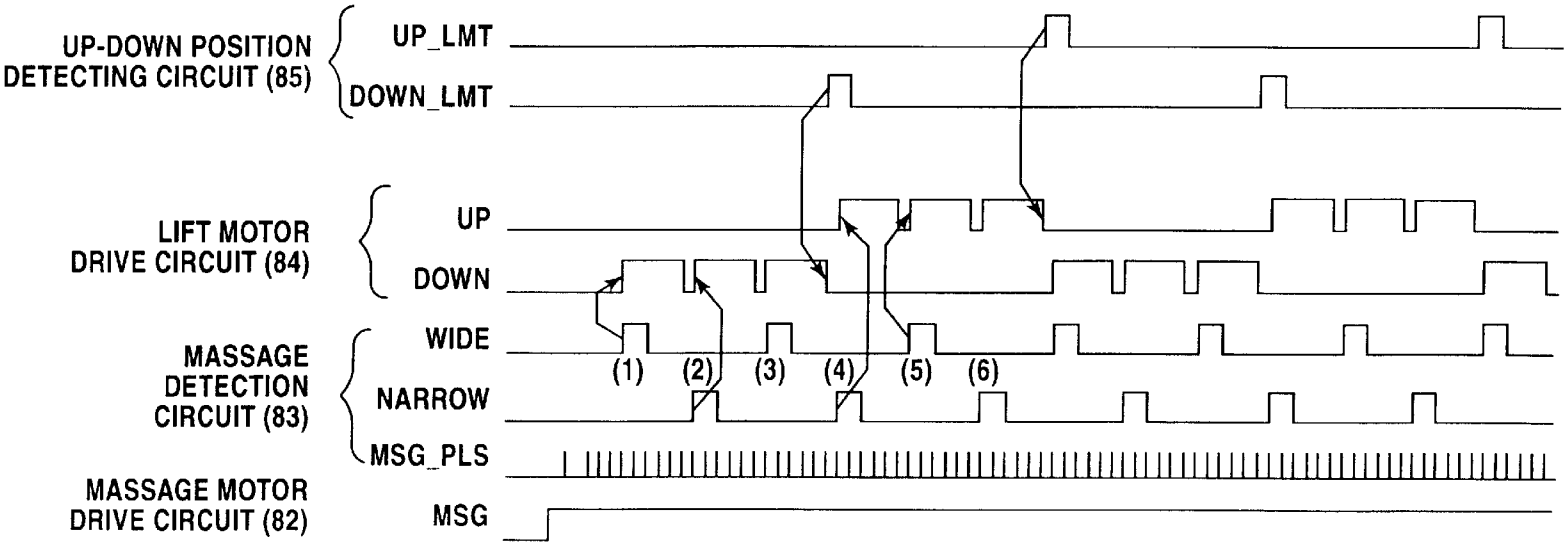
Figure 17A:
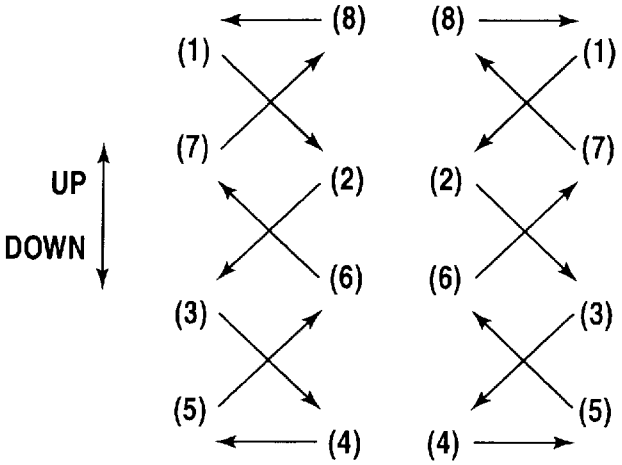
Figure 17B:
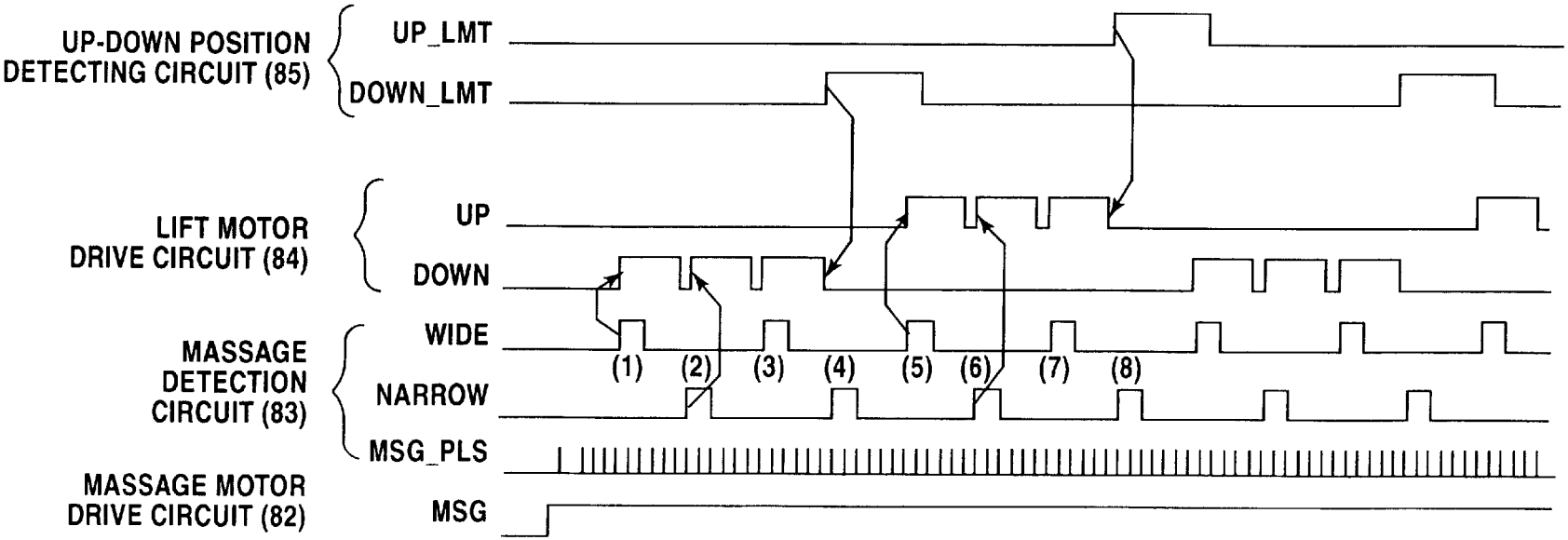

With regard to FIG. 7, (a) is a diagram showing the paths of movement of kneading balls in operation 1, and (b) is a timing chart of operation 1;

FIG. 8 is a flow chart of operation 1;

With regard to FIG. 9, (a) is a diagram showing the paths of movement of the kneading balls in another example of operation 1, and (b) is a timing chart of the same;

With regard to FIG. 10, (a) is a diagram showing the paths of movement of the kneading balls in another example of operation 1, and (b) is a timing chart of the same;

FIG. 11 is a diagram showing the paths of movement of the kneading balls in another example of operation 1;

With regard to FIG. 12, (a) is a diagram showing the paths of movement of the kneading balls in operation 2, and (b) is a timing chart of the same;

FIG. 13 is a flow chart of operation 2;

With regard to FIG. 14, (a) is a diagram showing the paths of movement of the kneading balls in another example of operation 2, and (b) is a timing chart of the same;

With regard to FIG. 15, (a) is a diagram showing the paths of movement of the kneading balls in another example of operation 2, and (b) is a timing chart of the same;

With regard to FIG. 16, (a) is a diagram showing the paths of movement of the kneading balls in another example of operation 2, and (b) is a timing chart of the same; and With regard to FIG. 17, (a) is a diagram showing the paths of movement of the kneading balls in another example of operation 2, and (b) is a timing chart of the same.

DESCRIPTION OF THE PREFERRED EMBODIMENTS

The present invention as applied to a massage machine 10 of the chair type will be described below. However, the invention is not limited to the chair type but can also be embodied as a massage machine of the bed type or further as a bed equipped with assisting devices.

In the following description, the term "front" refers to the direction toward which the user seated in a chair 12 faces, the term "rear" to the opposite direction, and the terms "right" and "left" respectively to the right-hand side and the left hand side of the user.

Description of the Construction

Figure 1:
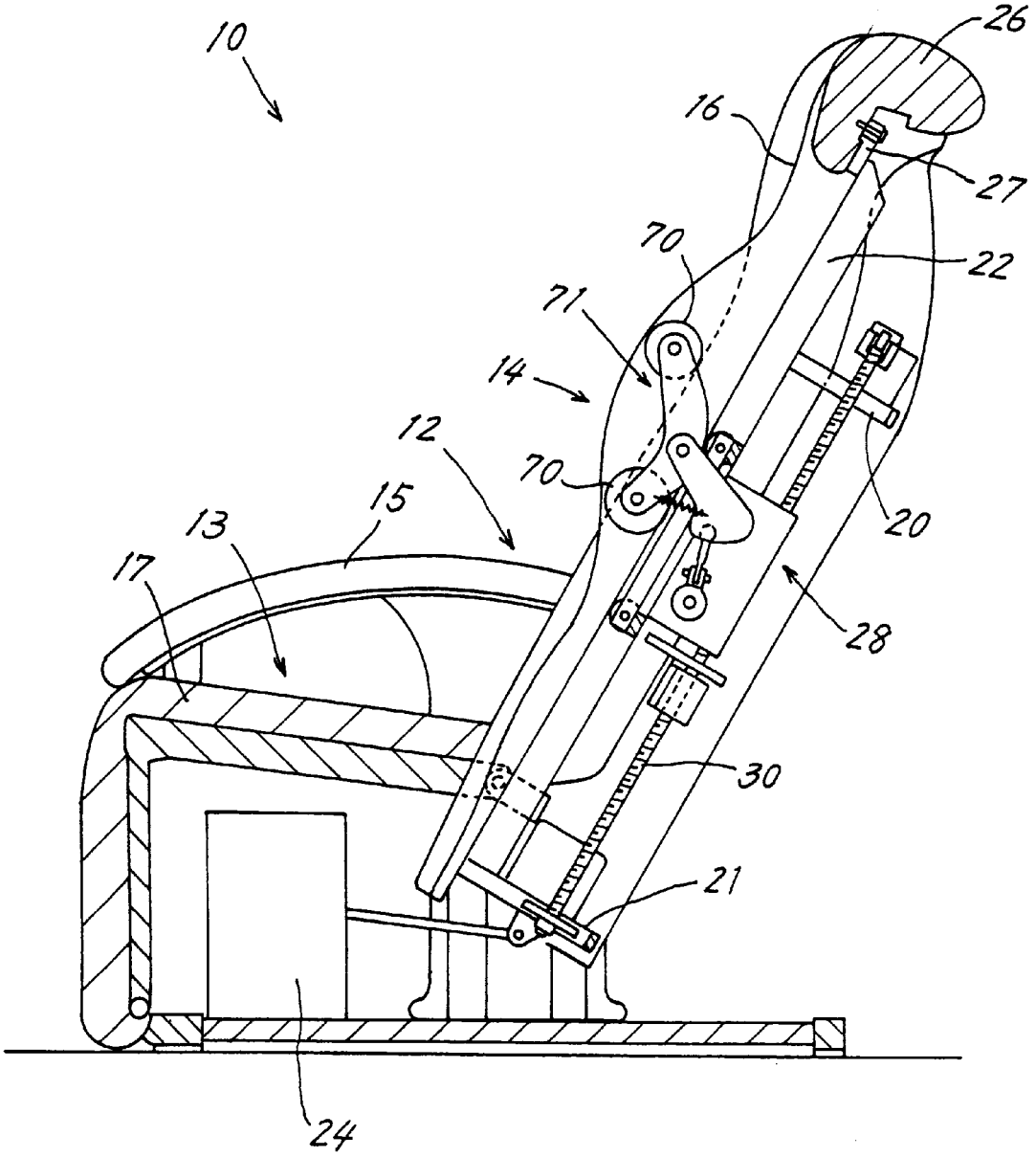
FIG. 1 is a view in vertical section of a massage machine.

With reference to FIG. 1, the chair 12 of the massage machine 10 comprises a seat 13 for the user, a backrest 14 extending upward from the rear end of the seat 13, and a pair of upward armrests 15 at the right and left sides of the seat 13. The seat 13, backrest 14 and armrests 15 are each made by connecting metal pipes, frames or plates together and covering the assembly with a fabric cover 16 and cushion 17.

Figure 2:
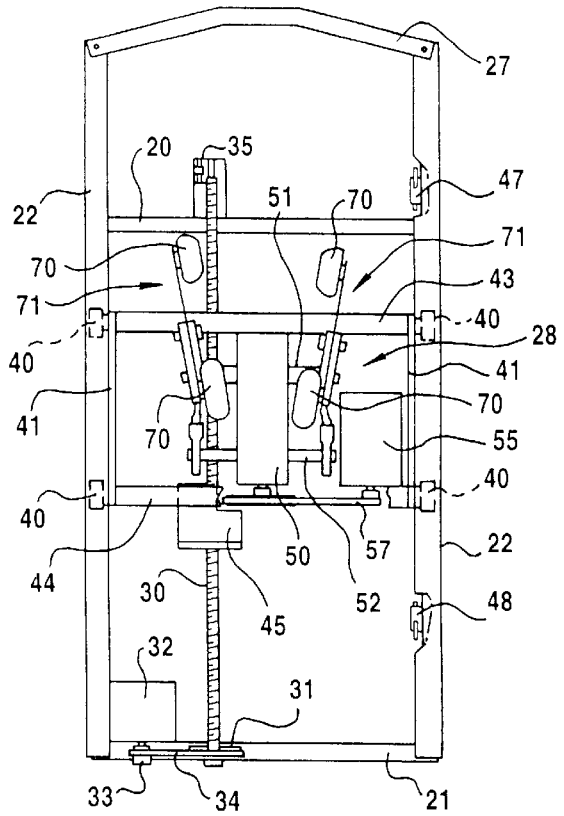
FIG. 2 is a front view of a backrest of the massage machine with a fabric cover removed.

As shown in FIGS. 1 and 2, the backrest 14 has an upper frame 20 and lower frame 21 positioned at an upper portion and lower portion thereof, respectively, and connected together at their opposite ends by a pair of guide rails 22, 22 extending upward in parallel. The guide rails 22, 22 have upper portions extending upward beyond the upper frame 20 and upper ends interconnected by a headrest frame 27 provided with a headrest 26 for the user's head to rest on. The guide rails 22, 22 each have a lower portion pivoted to a frame providing the seat 13. The lower frame 21 is connected to a known reclining mechanism 24, which renders the backrest 14 pivotally movable relative to the seat 13.

The guide rails 22, 22 are generally U-shaped in cross section and positioned with their grooves opposed to each other. A massage unit 28 is supported by, and movable upward and downward along, the rails 22, 22.

A screw rod 30 parallel to the guide rails 22, 22 is rotatably supported by the upper and lower frames 20, 21. As shown in FIG. 2, the screw rod 30 has at its lower end a pulley 31, which is coupled by a belt 34 to a pulley 33 on a lift motor 32 mounted on the lower frame 21, thus providing lift means. When driven, the lift motor 32 rotates the screw rod 30 forward or reversely. The screw rod 30 extends through the upper frame 20 and carries at its upper end an encoder 35 for measuring the number of revolutions of the rod 30. The encoder 35 is connected to the control circuit 37 to be described later.

Figure 3:
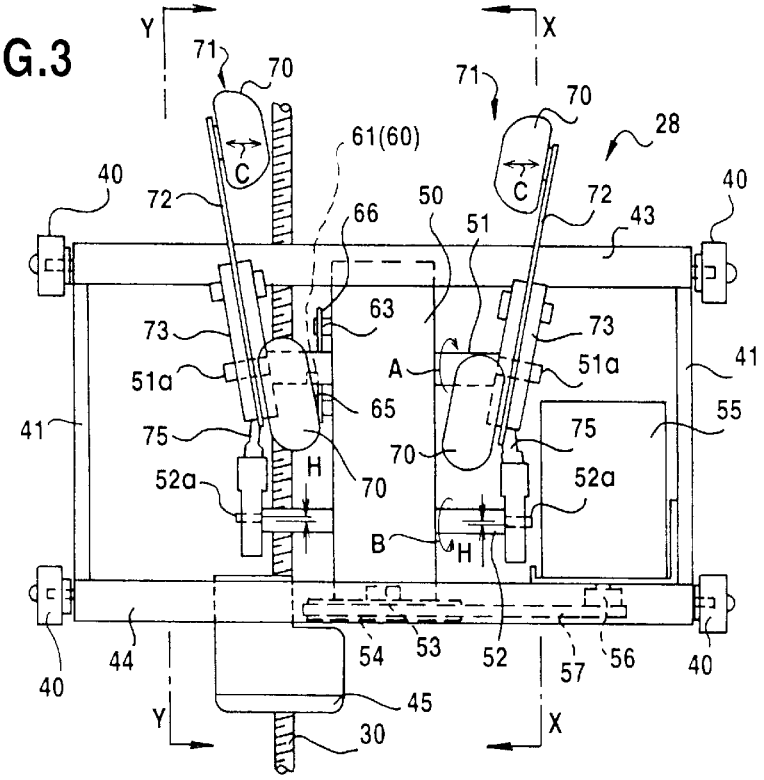
FIG. 3 is a front view of a massage unit.

With reference to FIG. 3, the massage unit 28 comprises a pair of side plates 41, 41 rotatably carrying at their upper and lower ends respective rollers 40, 40, 40, 40 fitting in the grooves of the guide rails 22, 22, and an upper support bar 43 and a lower support bar 44 respectively interconnecting the upper and lower ends of the side plates 41, 41. The lower support bar 44 has a lift member 45 formed with a threaded bore, with the screw rod 30 extending through the lift member 45 and screwed in the bore. When the screw rod 30 is rotated by the operation of the lift motor 32, the resulting thrust of the screw moves the massage unit 28 upward or downward along the guide rails 22, 22.

The upper and lower limit positions of the massage unit 28 are detected by limit switches 47, 48 provided respectively at upper and lower portions of one of the guide rails 22 as shown in FIG. 2. Upon the massage unit 28 reaching the upper or lower limit position, the upper support bar 43 or lower support bar 44 comes into contact with the limit switch 47 or 48, which detects the ascent or descent of the massage unit 28 to the limit and feeds a detection signal to the control circuit 37.

A gear box 50 is mounted on the upper and lower support bars 43, 44 approximately at the midportions thereof. The gear box 50 has a kneading shaft 51 extending laterally therethrough and rotatable at a low speed, and a tapping shaft 52 laterally extending through the gear box 50 below the kneading shaft 51 and rotatable at a high speed. A massage shaft 53 projects out from the bottom wall of the gear box 50 for driving these two shafts 51, 52. A pulley 54 mounted on the lower end of the massage shaft 53 is coupled by a belt 57 to a pulley 56 on a massage motor 55 mounted on the lower support bar 44 to provide means for moving therapeutic fingers (to be described later) toward and away from each other. The rotation of the massage motor 55 rotates the massage shaft 53 forward or reversely.

Although the internal construction of the gear box 50 will not be described, the operation of the gear box is known and such that the massage shaft 53, when rotated forward, rotates only the kneading shaft 51 at a low speed in the direction of arrow A in FIG. 3. with the tapping shaft 52 held at rest owing to the disengagement of a clutch thereof, the massage shaft 53 being reversely rotatable to rotate only the tapping shaft 52 at a high speed in the direction of arrow B in FIG. 3, with the kneading shaft 51 held out of rotation owing to the disengagement of a clutch of the shaft.

The pulley 54 on the massage shaft 53 is provided with an encoder (not shown) for detecting the number of revolutions of the shaft 53. The encoder is electrically connected to the control circuit 37 to be described later.

Figure 5:
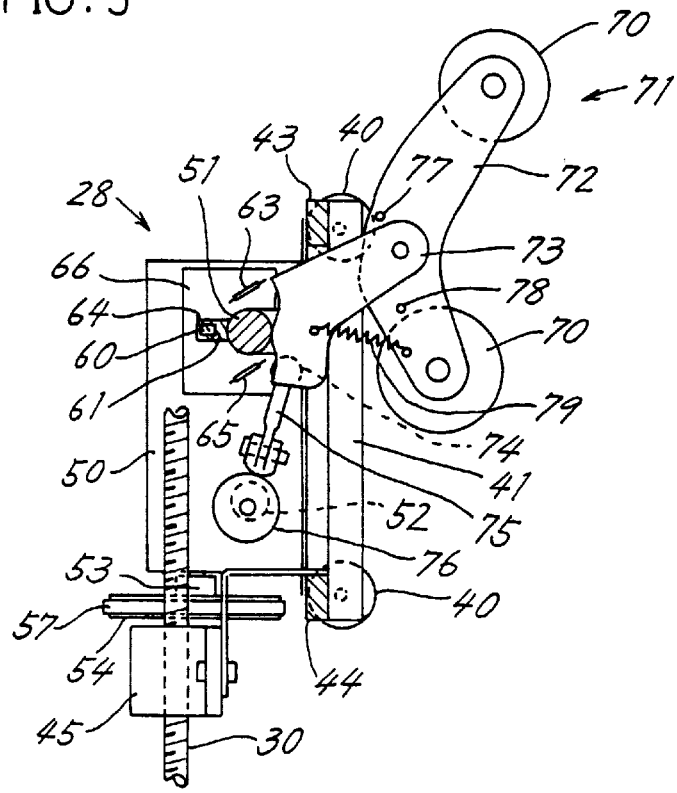
FIG. 5 is a view in section taken along the line Y—Y in FIG. 3 and showing the massage unit as it is seen in the direction of arrows.

The kneading shaft 51, which is positioned at the upper side of the gear box 50 has opposite ends 51*a* projecting from the box 50 and bent in the same direction. As seen in FIG. 5, one end of the kneading shaft 51 is formed with a projection 61 internally provided with a magnet 60 and positioned on the side thereof toward which the end is bent. The gear box 50 is provided on a wall surface thereof with a base plate 66 opposed to the path of movement of the magnet 60 and carrying three reed switches 63, 64, 65 thereon. The reed switches are arranged respectively above, to the rear of and below the kneading shaft 51. These reed switches 63, 64, 65 are electrically connected to the control circuit 37. When the upper reed switch 63 detects the magnet 60, the kneading balls 70, 70 to be described below are the largest distance away from each other. When the lower reed switch 65 detects the magnet 60, the opposed kneading balls are spaced from each other by the smallest distance. When the rear reed switch 64 detects the magnet 60 with the rotation of the kneading shaft 51 in the direction of arrow A in FIG. 3, the kneading balls are moving toward each other from the greatly spaced-apart position and spaced apart by a distance intermediate between the largest distance and the smallest distance.

The tapping shaft 52, which is positioned at the lower side of the gear box 50, has opposite ends 52*a* projecting from the gear box 50 and out of alignment with the axis of the shaft 52 by a distance H as seen in FIG. 3. The ends are eccentric symmetrically with the shaft axis, and each end is eccentric as shifted from the other end by 180 degrees about the axis.

Figure 4:
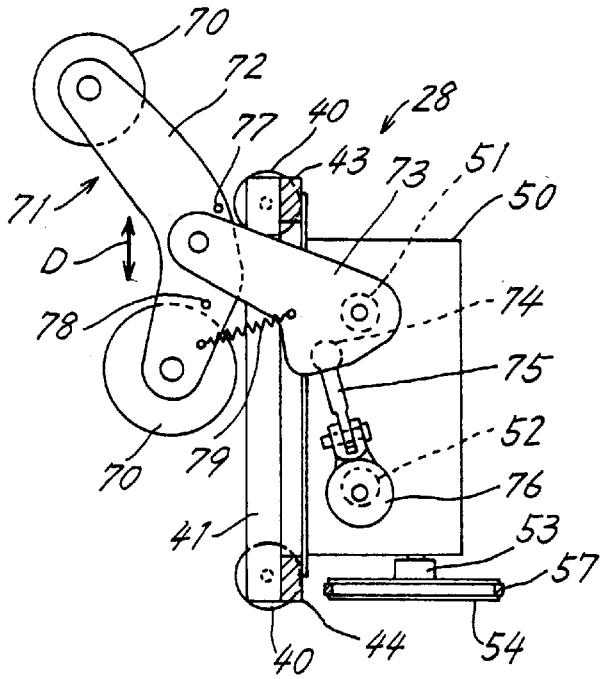
FIG. 4 is a view in section taken along the line X—X in FIG. 3 and showing the massage unit as it is seen in the direction of arrows.

With reference to FIGS. 3 and 4, therapeutic fingers 71, 71 are arranged at the right and left sides of the gear box 50. Each of the fingers 71 comprises a platelike arm 72 bent at the approximate midportion thereof at an obtuse angle, and a pair of kneading balls 70 attached to the respective ends of the arm 72 inwardly thereof.

The arm 72 is pivoted at the bent portion to a lever 73 in the form of a plate. The lever 73 has abase end rotatably supported by the end of the kneading shaft 51. Since the end 51*a* of the kneading shaft 51 is bent as aforementioned, the lever 73 attached to the shaft 51 is inclined relative thereto. When the kneading shaft 51 rotates, the lever 73 deflects rightward and leftward owing to the inclination of the end 51*a*.

The lever 73 has a lower end, to which a connecting rod 75 is attached by a ball joint 74. The connecting rod 75 is pivoted to an eccentric member 76 attached to the end of the tapping shaft 52.

Projecting from the arm 72 are upper and lower pins 77, 78 for limiting the angle through which the arm 72 is pivotally movable relative to the lever 73. The arm 72 is connected at a position below the lower pin 78 to the lever 73 by a spring 79 for biasing the lower portion of the arm 72 toward the lever 73 at all times. When the arm 72 is unloaded, the lower pin 78 is in bearing contact with the lever 73 under the action of the spring 79. When the kneading balls 70 are pressed against the user with the start of massage, the kneading balls 70 are movable within the limits of pivotal movement of the arm 72 relative to the lever 73 against the force of the spring 79.

The massage machine 10 is operated variously by commands from a control unit 86 (not shown in detail). The control unit 86 has a lift button for adjusting the massage unit 28 to an UP level or DOWN level, kneading button for starting a kneading operation, tapping button for starting a tapping operation, width adjusting button for adjusting the spacing between the kneading balls to "WIDE", "MIDDLE" or "NARROW", speed adjusting button for adjusting the speed of kneading operation or tapping operation to "HIGH", "MEDIUM" or "LOW", operation 1 button and operation 2 button for starting operation 1 and operation 2, respectively, as will be described later, reclining button for operating the reclining mechanism 24 and stop button for suspending the operations. A command signal entered in the control unit 86 by the user pressing one of the buttons is transmitted to the control circuit 37.

The control circuit 37 serving as means for controlling the operation of the massage machine 10 will be described.

Figure 6:
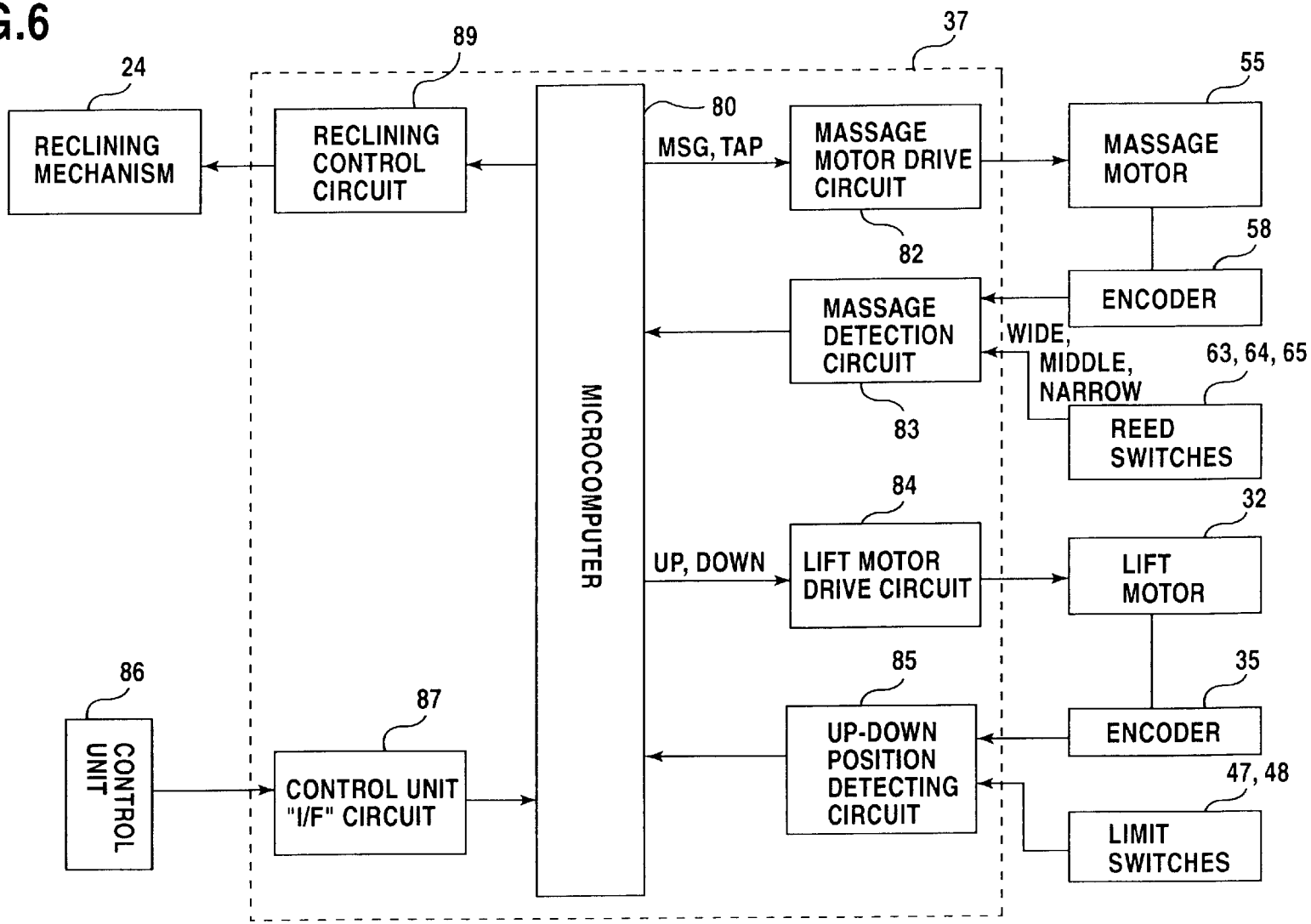
FIG. 6 is a block diagram of a control circuit.

FIG. 6 shows the control circuit 37 consisting mainly of a microcomputer 80. The control circuit 37 is provided in a suitable portion of the massage machine 10.

Connected to the microcomputer 80 are a massage motor drive circuit 82 for controlling the operation of the massage motor 55, and a massage detection circuit 83 for receiving the output value of the encoder 58 provided on the pulley 54 on the massage shaft 53 and the output value of the reed switches 63, 64, 65 for detecting the angle of rotation of the kneading shaft 51.

The drive circuit 82 has a PWM circuit (not shown) for pulse width modulation and adjusts the average drive voltage to be supplied to the massage motor 55 to control the speed of rotation of the massage motor 55.

The massage detection circuit 83 checks whether the massage motor 55 is rotating at a predetermined speed by detecting encoder pulses. If the actual speed is not in match with the predetermined speed, the drive circuit 82 adjusts the voltage to be supplied. The circuit 83 also receives the output value from the reed switches 63 to 65 to detect the spacing between the opposed kneading balls 70, 70.

Further connected to the microcomputer 80 are a lift motor drive circuit 84 for controlling the operation of the lift motor 32, and an up-down position detecting circuit 85 for receiving the output value of the encoder 35 for detecting the number of revolutions of the screw rod 30 and the output value of the upper or lower limit switch 47 or 48 for detecting the upper or lower limit position of the massage unit 28.

The number of revolutions of the screw rod 30 starting with the detection of the massage unit 28 by the upper limit switch 47 is calculated by the position detecting circuit 85 as a cumulative value of encoder pulses to detect the current position of the massage unit 28. The current position of the unit 28 is detectable alternatively based on the lower limit switch 48 or both the upper and lower limit switches 47, 48.

Also connected to the microcomputer 80 is a control unit I/F circuit 87 for receiving operation signals from the control unit 86. As previously stated, the control unit 86 has many control buttons, and the command signals from such buttons are transmitted to the microcomputer 80 via the control unit I/F circuit 87 for effecting various kinds of control.

The control circuit 37 further has a reclining control circuit 89 for controlling the reclining mechanism 24 to pivotally move the backrest 14. The reclining circuit 89 is known and therefore will not be described.

Description of the Operations

The basic operation of the massage machine 10 will be described first. The massage operation of the present invention includes operation 1 and operation 2 to be described below.

When the power supply for the massage machine 10 is turned on, the massage unit 28 is checked for the initial position in order to detect the amount of movement of the massage unit 28 from the pulse number of the encoder 35 on the screw rod 30 by addition or subtraction. Taken as the initial position of the massage unit 28 according to the invention is the upper limit position of the unit 28 where the unit 28 comes into contact with the upper limit switch 47. Accordingly, the massage unit 28 moves upward until it is detected by the upper limit switch 47. Upon this switch 47 detecting the massage unit 28, the integral or cumulative value of pulses from the encoder on the screw rod 30 is reset.

The massage machine 10 in this state can be brought into various operations.

[Up-Down Movement of the Massage Unit]

When the user presses the lift button for "UP" or "DOWN", the command signal is sent to the control circuit 37, in which the signal is fed to the microcomputer 80 via the control unit I/F circuit 87 and delivered to the lift motor drive circuit 84 as an UP signal or DOWN signal. In response to this signal, the lift motor 32 rotates in a specified direction. The number of revolutions of the screw rod 30 as rotated by the lift motor 32 is counted in terms of the number of encoder pulses as a cumulative value when the massage unit 28 in a downward movement. When the unit 28 is in an upward movement, the number of encoder pulses is subtracted from the cumulative value. The cumulative value indicates the current position of the massage unit 28.

The massage unit 28 ascends or descends until it is detected by the upper or lower limit switch 47 or 48, and can be halted at a desired position.

[Kneading Operation]

When the user presses the kneading button, the resulting command signal is similarly sent to the control unit 87 in which the signal is fed to the microcomputer 80 via the I/F circuit 87 and given to the massage motor drive circuit 82 as an MSG signal. On receiving the MSG signal, the circuit 82 rotates the massage motor 55 so as to rotate the massage shaft 53 forward, drivingly rotating only the kneading shaft 51 in the direction of arrow A in FIG. 3. Since the levers 73 are rotatably supported as inclined with respect to the axis of rotation of the kneading shaft 51, the rotation of the shaft 51 reciprocatingly moves the opposed kneading balls 70, 70 toward and away from each other approximately in parallel to the lateral direction as indicated by arrows C in FIG. 3 to massage the user by kneading. Each of the levers 73 is rotatable supported at its lower end by the eccentric member 76 by means of the ball joint 74 and connecting rod 75 at this time and is therefore movable as inclined free of trouble.

With the rotation of the kneading shaft 51, the reed switches 63, 64, 65 on the gear box 50 successively detect the magnet 60. When each reed switch detects the magnet 60, the resulting detection signal is transmitted to the massage detection circuit 83. More specifically, the detection of the magnet 60 by the upper reed switch 63 delivers to the detection circuit 83 WIDE signal indicating that the spacing between the opposed kneading balls 70, 70 is largest. The detection of the magnet 60 by the rear reed switch 64 gives the circuit 83 MIDDLE signal indicating that the spacing between the kneading balls 70, 70 is intermediate. The detection of the magnet 60 by the lower reed switch 65 sends to the circuit 83 NARROW signal indicating that the spacing between the kneading balls 70, 70 is smallest.

Without performing the kneading operation, it is possible to vary the spacing between the kneading balls 70, 70, i.e., to effect width adjustment only. In this case, the width adjusting button on the control unit is pressed to select one of "WIDE", "MIDDLE" and "NARROW" for the spacing between the kneading balls, whereupon a MSG is transmitted to the massage motor drive circuit 82, causing the massage motor 55 to rotate only the kneading shaft 51. The rotation of the shaft 51 alters the spacing between the balls 70, 70, and the reed switches 63 to 65 successively produce detection signals indicating varying ball-to-ball spacings. When the signal (one of WIDE signal, MIDDLE signal and NARROW signal) indicating the ball spacing selected by the user is detected, the drive circuit 82 stops the massage motor 55 to bring the balls 70, 70 out of movement. In this way, the spacing between the kneading balls is adjusted to the spacing desired by the user.

When moved up and down in this state, the massage unit 28 performs rolling massage. When brought into a tapping operation, the unit 28 performs tapping massage with the ball spacing desired by the user.

[Tapping Operation]

When the user presses the tapping button, the resulting command signal is sent to the control circuit 37, in which the signal is fed to the microcomputer 80 by way of the control unit I/F circuit 87 and delivered to the massage motor drive circuit 82 as a TAP signal. On receiving the TAP signal, the circuit 82 drives the massage motor 55 to rotate the massage shaft 53 reversely, drivingly rotating only the tapping shaft 52 in the direction of arrow B in FIG. 3. Since each eccentric member 76 is supported by the tapping shaft 52 out of alignment with the axis of rotation thereof, with each lever 73 having its base end rotatably supported by the kneading shaft 51 at rest, the rotation of the tapping shaft 52 reciprocatingly moves the kneading balls 70, 70 generally upward and downward as indicated by the arrow D in FIG. 4 to massage the user by tapping.

In the kneading operation and tapping operation described, the massage motor 55 is rotatable at an altered speed to move the kneading balls at an adjusted speed. For the adjustment of operating speed, the speed adjusting button on the control unit is pressed to select one of "HIGH", "MEDIUM" and "LOW" speeds, whereupon the PWM circuit (not shown) of the massage motor drive circuit 82 adjusts the drive voltage to be applied to the motor 55. When the speed of rotation of the motor 55 is adjusted to the desired value, the speed of the kneading balls 70, 70 operated by the motor 55 alters. Whether the balls 70, 70 are adjusted to the desired speed can be checked by measuring the interval of encoder pulses from the encoder 58 provided on the pulley 54 of the massage shaft 53.

Next, the massage operations of the invention will be described.

[Operation 1]

With reference to FIG. 7(*a*), the timing chart of FIG. 7(*b*) and the flow chart of FIG. 8, a massage operation (hereinafter referred to as "operation 1") will be described wherein the kneading balls 70, 70 are initiated into a movement toward each other simultaneously with the start of ascent and descent of the massage unit 28, and the balls 70, 70 are moved away from each other while the massage unit 28 is held out of up-and-down movement. The arrows in FIG. 7(*a*) show the paths of movement of the opposed kneading balls.

First, the massage unit 28 is moved to a desired level, and the operation 1 button on the control unit is then pressed (step 1), whereupon a command signal for operation 1 is transmitted to the control circuit 37.

The microcomputer 80 receiving the command signal transmits an MSG signal (see FIG. 7(*b*)) to the massage motor drive circuit 82 to drive the massage motor 55, reciprocatingly moving the kneading balls 70, 70 leftward and rightward (step 2).

When the distance between the balls 70, 70 becomes largest (FIG. 7(*a*), ①) with the start of kneading operation, the upper reed switch 63 transmits WIDE signal (step 3). When the control circuit 37 receives the WIDE signal, DOWN signal (FIG. 7(*b*), ①) is given to the lift motor drive circuit 84, initiating the lift motor 32 into operation to lower the massage unit 28 (step 4). In step 4, the opposed kneading balls 70, 70 descend while moving toward each other.

The kneading shaft 51 further rotates, reducing the distance between the balls 70, 70 to the greatest extent (FIG. 7(*a*), ②), whereupon the lower reed switch 65 produces NARROW signal (step 5, FIG. 7(*b*), ②). When the control circuit 37 receives the NARROW signal, the lift motor drive circuit 84 ceases transmitting the DOWN signal to stop the lift motor 32 (step 6).

With the massage unit 28 held at rest, the kneading shaft 51 further rotates, increasing the distance between the kneading balls 70, 70 to the greatest extent again (FIG. 7(*a*), ③), whereupon the upper reed switch 63 emits WIDE signal (step 7).

When the control circuit 37 receives the WIDE signal with the massage unit 28 in its lowered position, UP signal is transmitted to the lift motor drive circuit 84 (FIG. 7(*b*), ③), driving the lift motor 32 and moving the unit 28 upward (step 8). These steps 7 and 8 move the opposed balls 70, 70 upward while moving the balls toward each other.

The kneading shaft 51 further rotates to reduce the spacing between the balls 70, 70 to the smallest distance again (FIG. 7(*a*), ④), whereupon the lower reed switch 65 emits NARROW signal (step 9). On the control circuit 37 receiving the NARROW signal, the lift motor drive circuit 84 ceases transmitting the UP signal (FIG. 7(*b*), ④) to bring the lift motor 32 to a halt (step 10).

With the massage unit 28 held at rest, the kneading shaft 51 further rotates, increasing the spacing between the balls 70, 70 to the largest distance again, whereupon the upper reed switch 63 emits WIDE signal, and the sequence returns to step 3 again.

The cycle described above is repeated until the stop button is pressed.

In the mode of massage provided by operation 1, the kneading operation of moving the balls 70, 70, as spaced apart by the largest distance, toward each other to a position closest to each other can be initiated simultaneously with the start of ascent of the massage unit 28 for an upward kneading operation, and can also be initiated simultaneously with the start of descent of the massage unit 28 for a downward kneading operation. Thus, the massage effect by the nipping-kneading operation and the massage effect by the upward and downward movement are available synergistically to provide highly effective massage.

With the foregoing embodiment, the massage unit is moved up and down based on the detection signals from the reed switches 63, 65 for detecting the rotation of the kneading shaft 51. However, it is possible to detect the number of encoder pulses of the screw rod 30 for the descent or ascent of the massage unit 28 in the first cycle, and to subsequently move the unit upward and downward based on the encoder pulse number. Thus, the number of encoder pulses of the screw rod 30 counted during the descent or ascent is taken as a reference pulse number, and the subsequent ascent and descent are suspended when the same number of pulses as the reference number are counted. This serves to eliminate a shift in the raised or lowered position due to the influence of a load on the balls 70, 70 or the massage unit 28.

It is possible to take as a reference pulse number the number of encoder pulses of the screw rod 30 counted during the descent, and to discontinue the ascent when a number of encoder pulses have been counted which is smaller than the reference pulse number by a predetermined value. Massage is then given at a position which is gradually lowered. Conversely, the number of encoder pulses of the screw rod 30 for the ascent may be made greater than the pulse number for the descent to gradually raise the position of massage.

The ascent and descent can of course be started or suspended based on the pulses from the encoder 58 on the pulley 54 of the massage shaft 53.

[Different Examples of Operation 1]

FIG. 9(*a*) and the timing chart of FIG. 9(*b*) show another example of operation 1. The arrows in FIG. 9(*a*) show the paths of movement of the opposed kneading balls as in the foregoing case.

With this example, DOWN signal for the massage unit 28 is produced simultaneously with WIDE signal of the kneading balls 70, 70, and UP signal is emitted simultaneously with NARROW signal. The massage unit 28 descends when the balls 70, 70 move toward each other, and the unit 28 ascends when the balls 70, 70 move away from each other for giving massage. The kneading balls 70, 70 move reciprocatingly obliquely straight. This example places an emphasis on the downward kneading mode of operation 1 described.

In the foregoing massage operations, the nipping-kneading operation may be performed at least once with the massage unit 28 held at rest in its raised position and/or lowered position as shown in FIGS. 10(*a*) and 10(*b*).

With the foregoing embodiments or examples, the massage unit 28 is raised or lowered simultaneously with the start of movement of the kneading balls 70, 70 toward or away from each other, whereas the ascent and descent need not be effected perfectly simultaneously with the lateral movement but may be initiated slightly before or after the approaching or opposite lateral movement as shown in FIG. 11. The portions surrounded by a circle in FIG. 11 indicate that the balls are moved toward or away from each other before or after the start of ascent or descent.

Although the massage motor 55 is rotated at a definite speed for massage operations according to the foregoing examples, the motor 55 can be rotated at different speeds for causing the kneading balls 70, 70 to move toward each other and for causing the balls to move away from each other to give massage in a wide variety of modes. In this case, it appears useful to rotate the motor 55 at a lower speed when moving the balls 70, 70 toward each other than when moving them away from each other in giving a higher massage effect although the effect may vary from person to person.

Furthermore, the massage motor 55 can be rotated at different speeds when the lift motor 32 is in rotation and when the motor 32 is at rest. For example, the massage motor 55 can rotated at a lower speed when the ascent and descent are effected with the approaching movement (e.g., see FIG. 7 (*a*), ① and ③) than when the departing movement only is effected with the massage unit 28 at rest (e.g., see FIG. 7(*a*), ② and ④). This results in more effective upward and downward kneading operations.

[operation 2]

With reference to FIG. 12(*a*), the timing chart of FIG. 12(*b*) and the flow chart of FIG. 13, a massage operation (hereinafter referred to as "operation 2") will be described in which the massage unit 28 is initiated into upward and downward rolling movements simultaneously with the start of movement of the kneading balls 70, 70 toward and away from each other, and the balls are moved toward and away from each other a number of times during the upward rolling movement, as well as during the downward rolling movement.

With this example, the upper limit for the rolling movement of the massage unit 28 is the position where the upper limit switch 47 on the guide rail 22 detects the unit 28, and the lower limit is the position where the lower limit switch 48 on the rail 22 detects the unit 28.

First, the massage unit 28 is moved to the position where it is detected by the upper limit switch 47, and the operation 2 button on the control unit is then pressed (step 1), whereupon a command signal for operation 2 is transmitted to the control circuit 37.

On receiving the command signal, the microcomputer 80 feeds an MSG signal (see FIG. 12(*b*)) to the massage motor drive circuit 82, driving the motor 55 to reciprocatingly move the kneading balls 70, 70 leftward and rightward (step 2).

With the start of kneading operation, the spacing between the balls 70, 70 increases to the largest distance (FIG. 12(*a*), ①), whereupon the upper reed switch 63 emits WIDE signal (step 3). When the control circuit 37 receives the WIDE signal, the microcomputer 80 feeds DOWN signal (FIG. 12(*b*), ①) to the lift motor drive circuit 84, initiating the lift motor 32 into operation and lowering the massage unit 28 (step 4). Step 4 moves the opposed balls 70, 70 downward while moving the balls toward each other.

The kneading shaft 51 further rotates to reduce the distance between the balls 70, 70 to the greatest extent (FIG. 12(*a*), ②), whereupon the lower reed switch 65 produces NARROW signal (step 5, FIG. 12(*b*), ②). Upon the control circuit 37 receiving the NARROW signal, the drive circuit 84 ceases transmitting the DOWN signal, bringing the lift motor 32 to a halt (step 6).

With the massage unit 28 at rest, the kneading shaft 51 further rotates, increasing the distance between the balls 70, 70 to the greatest extent again (FIG. 12(*a*), ③), whereupon the upper reed switch 63 produces WIDE signal, followed by step 3 again. The operation of step 3 through step 6 is repeated until the lower limit switch 48 transmits DOWN-LMT signal upon detecting the massage unit 28 (step 7).

When the DOWN-LMT signal is fed to the control circuit 37 by the switch 48 detecting the unit 28, the balls 70, 70 move toward and away from each other with the massage unit 28 at rest until NARROW signal is produced again.

Upon the control unit 37 receiving the NARROW signal (step 8), UP signal is given to the lift motor drive circuit 84 (FIG. 12(*b*), ⑩), which drives the lift motor 32 to raise the unit 28 (step 9). Step 9 raises the opposed kneading balls 70, 70 while moving the balls away from each other.

The kneading shaft 51 further rotates, increasing the distance between the balls 70, 70 to the greatest extent (FIG. 12(*a*), ⑪), whereupon the upper reed switch 63 emits WIDE signal (step 10). The control circuit 37 receives the WIDE signal, whereupon the lift motor drive circuit 84 ceases transmitting the UP signal to stop the lift motor 32 (step 11).

With the massage unit 28 at rest, the kneading shaft 51 further rotates, reducing the spacing between the balls 70, 70 to the smallest distance again. whereupon NARROW signal is produced, followed by step 8 again. The operation of step 8 through step 11 is repeated until the upper limit switch 47 transmits UP-LMT signal upon detecting the massage unit 28 (step 12).

When the Up-LMT signal is transmitted to the control circuit 37 by the upper limit switch 47 detecting the massage unit 28, the sequence returns to step 3.

The above cycle is repeated until the stop button is pressed. When the stop button is pressed, the operation is suspended at an optional step.

The massage given by operation 2 is a kneading operation wherein the kneading balls 70, 70, as spaced apart by the largest distance, are moved toward each other to the closest proximity with each other, simultaneously with the start of descent of the massage unit 28, so as to mainly effect a downward kneading operation.

Although the massage unit 28 is moved upward and downward based on the detection signals from the reed switches 63, 65 for detecting the rotation of the kneading shaft 51, the movement may be controlled alternatively based on the number of encoder pulses of the screw rod 30. The movement is of course similarly controllable based on the pulses from the encoder 58 provided on the pulley 54 of the massage shaft 53.

[Different Examples of Operation 2]

FIG. 14(*a*) and the timing chart of FIG. 14(*b*) show another example of operation 2. The arrows in FIG. 14(*a*) show the paths of movement of the opposed kneading balls as in the foregoing examples.

This example places an emphasis on both downward kneading operation and upward kneading operation.

During downward rolling movement, DOWN signal is transmitted upon the receipt of WIDE signal to perform a downward kneading operation, and the transmission of the DOWN signal is suspended upon the receipt of NARROW signal, followed by a movement of the balls away from each other in the same state. The downward rolling movement is continued until the lower limit switch 48 detects the massage unit 28.

During the upward rolling movement, UP signal is transmitted upon the receipt of WIDE signal to perform an upward kneading operation, and the transmission of the UP signal is suspended upon the receipt of NARROW signal, followed by a movement of the balls away from each other in the same state. Similarly, the upward rolling movement is continued until the upper limit switch 47 detects the massage unit 28.

In the foregoing massage operation, a nipping-kneading operation may be performed at least once with the massage unit held at rest in its raised position and/or lowered position as seen in FIG. 15(*a*) and FIG. 15(*b*).

FIGS. 16 and 17 show other examples of operation 2.

The example shown in FIG. 16 is such that the massage unit 28 is continually moved upward and downward for kneading operation almost without halting the unit. With the example shown in FIG. 17, the therapeutic fingers are moved away from each other once with the massage unit 28 at rest in the raised position and lowered position of rolling movement.

With these examples, drive commands (UP signal, DOWN signal) are given to the lift motor 32 based on the WIDE signal and NARROW signal as in the foregoing case. On the other hand, the lift motor 32 in rotation is brought to a halt based on the number of pulses (MSG-PLS in the drawings) from the encoder 58 provided on the pulley 54 of the massage shaft 53. With the start of operation of the lift motor 32, the massage detection circuit 83 counts the number of encoder pulses, and upon the pulse number reaching a predetermined value, transmission of Up signal and DOWN signal from the lift motor drive circuit 84 to the lift motor 32 is suspended to stop the upward and downward movement of the massage unit 28.

The massage unit 28 is changed over from ascent to descent and vice verse based on the signals (UP-LMT, DOWN-LMT) of the upper and lower limit switches 47, 48 detecting the massage unit 28.

These examples are adapted to give massage with an emphasis placed on the rolling movement over the entire rolling range of the massage unit 28.

Although the entire length of the guide rails provides the rolling range of the massage unit 28 according to the above examples, for example, the distance of upward and downward movement for moving the kneading balls toward and away from each other a specified number of times may be taken as the rolling range.

With the foregoing examples, the massage unit 28 is raised or lowered simultaneously with the start of movement of the kneading balls 70, 70 toward or away from each other, whereas the ascent and descent need not be effected perfectly simultaneously with the lateral movement but may be initiated slightly before or after the approaching or departing lateral movement.

Although the massage motor 55 is rotated at a definite speed for massage operations according to the foregoing examples, the motor 55 can be rotated at a lower or higher speed when causing the kneading balls 70, 70 to move toward each other than when causing the balls to move away from each other to give massage in a wide variety of modes.

Furthermore, the massage motor 55 can be rotated at different speeds when the lift motor 32 is in rotation and when the motor 32 is at rest. For example, the massage motor 55 can rotated at a lower speed when the ascent and descent are effected with the approaching movement (e.g., see FIG. 12(*a*), ① and ③) than when the departing movement only is effected with the massage unit 28 at rest (e.g., see FIG. 12(*a*), ② and ④). This results in more effective upward and downward kneading operations.

Apparently the present invention can be modified or altered by one skilled in the art without departing from the spirit of the invention. Such modifications or alterations are included within the scope of the invention as set form in the appended claims.

What is claimed is:

1. A massage machine, comprising:

a backrest of a chair, bed or the like for supporting the back of a user to be massaged;

a kneading shaft supported in the backrest and reciprocatingly movable along a longitudinal direction of the backrest;

a pair of therapeutic fingers connected to the kneading shaft and movable toward or away from each other by the rotation of the kneading shaft;

a first drive motor associated with the therapeutic fingers and having a shaft rotatable in the forward or reverse direction in order for the therapeutic fingers to move along a longitudinal direction of the backrest;

a second drive motor connected to the kneading shaft and for rotating the kneading shaft to move the therapeutic fingers toward or away from each other;

detection means provided in the vicinity of the kneading shaft and for sensing the rotation of the kneading shaft, the detecting means being adapted to detect the smallest spacing between the therapeutic fingers by making a first signal when the therapeutic fingers are spaced from each other by the smallest distance and to detect the largest spacing between the therapeutic fingers by making a second signal when the therapeutic fingers are spaced from each other by the largest distance;

control means connected to the detection means and for controlling the rotation of the first and second drive motors; and the control means being operative to drive the second drive motor to move the therapeutic fingers toward or away from each other, and to drive the first drive motor into forward or reverse rotation depending on the signals sent from the detection means, to move the therapeutic fingers along the longitudinal direction ofthe backrest, so that combination of the moves caused by the first and second motors provides the therapeutic fingers with a movement toward an oblique direction in the backrest.

2. The massage machine as defined in claim 1, wherein the control means operates to stop the first drive motor when receiving the signal from the detection means, and then operates to restart the first drive motor when further receiving the signal from the detecting means one or more times.

3. The massage machine as defined in claim 1, wherein the control means operates to start the first drive motor when receiving the signal from the detection means, and then operates to switch the rotating direction of the first drive motor when further receiving the signal from the detecting means one or more times.

4. The massage machine as defined in claim 1, further comprising detection means connected to the control means, and for detecting that the therapeutic fingers reach either one of the longitudinal distal ends of the backrest and then making a signal indicating that the therapeutic fingers reach there, the control means being operative to rotate the first drive motor in one direction until receiving the signal from the further detection means, and to switch the rotating direction of the first drive motor when receiving the signal from the further detection means.

5. The massage machine as defined in claim 1, wherein the control means controls a rotating speed of the second drive motor in order that the therapeutic fingers move away from each other at a higher speed than a speed when moving the fingers toward each other.

6. The massage machine as defined in claim 1, wherein the kneading shaft is provided with a magnet;

the first detecting means comprised a first reed switch opposed to a path of movement of the magnet and for detecting the magnet when the therapeutic fingers are spaced from each other by the smallest distance, and a second reed switch opposed to the path of movement of the magnet and for detecting the magnet when the therapeutic fingers are spaced form each other by the largest distance; and each ofthe first and second detecting means being adapted to make a signal when the magnet is detected, so that the change of the spacing between the therapeutic fingers is detected.

* * * * *